US008136710B2

(12) United States Patent
Stratton

(10) Patent No.: US 8,136,710 B2
(45) Date of Patent: Mar. 20, 2012

(54) POWERED STAPLING DEVICE

(75) Inventor: Lawrence D. Stratton, Redmond, WA (US)

(73) Assignee: Cascade Technologies, LLC, Kirkland, WA (US)

( * ) Notice: Subject to any disclaimer, the term of this patent is extended or adjusted under 35 U.S.C. 154(b) by 0 days.

(21) Appl. No.: 11/681,018

(22) Filed: Mar. 1, 2007

(65) Prior Publication Data

US 2008/0210735 A1 Sep. 4, 2008

(51) Int. Cl.
*B25C 5/10* (2006.01)

(52) U.S. Cl. ..... 227/148; 227/110; 227/140

(58) Field of Classification Search ..... 272/107, 272/110, 116, 140; 227/107, 110, 116, 140, 227/148

See application file for complete search history.

(56) References Cited

U.S. PATENT DOCUMENTS 3,576,288 A * 4/1971 Green ..... 227/111
4,396,139 A * 8/1983 Hall et al. ..... 227/19
4,478,362 A * 10/1984 Foslien ..... 227/19
4,582,237 A * 4/1986 Storace et al. ..... 227/19
4,596,350 A * 6/1986 Smith et al. ..... 227/19
5,217,472 A * 6/1993 Green et al. ..... 606/139
5,257,713 A * 11/1993 Green et al. ..... 227/19
5,289,963 A * 3/1994 McGarry et al. ..... 227/175.1
5,405,344 A * 4/1995 Williamson et al. ..... 606/1
5,564,615 A * 10/1996 Bishop et al. ..... 227/175.1
5,662,662 A * 9/1997 Bishop et al. ..... 606/143
5,862,972 A * 1/1999 Green et al. ..... 227/175.1
5,937,951 A * 8/1999 Izuchukwu et al. ..... 227/176.1
6,652,538 B2 * 11/2003 Kayan et al. ..... 606/143
6,843,402 B2 * 1/2005 Sims et al. ..... 227/148
6,978,921 B2 * 12/2005 Shelton et al. ..... 227/176.1
2003/0024962 A1 * 2/2003 Sims et al. ..... 227/148

* cited by examiner

*Primary Examiner* — Lindsay Low
*Assistant Examiner* — Gloria R Weeks
(74) *Attorney, Agent, or Firm* — Christensen O'Connor Johnson Kindness PLLC

(57) ABSTRACT

The present invention relates to an powered stapling device and, more specifically, but not limited to, a powered stapling device for driving staples over a strip of linear material, such as a cable located in an otherwise inaccessible or difficult to reach place. The stapling device includes an actuation mechanism, a handle, a staple ejection mechanism, and a drive arm operable along a primary axis of the stapling device. The actuation mechanism provides energy to the drive arm, which in turn engages the staple ejection mechanism, which in turn drives the staple. At least a portion of the staple engagement mechanism may be positioned at an angle with respect to the primary axis. This configuration of the staple engagement mechanism allows the stapling device to drive the staple at an angle relative to the linear object being stapled, even when the primary axis of stapling device is aligned substantially parallel or substantially perpendicular to the linear object being stapled.

21 Claims, 2 Drawing Sheets

POWERED STAPLING DEVICE

FIELD OF THE INVENTION

This invention relates generally to a powered stapling device and, more specifically, to a powered stapling device for stapling objects that are in difficult to reach places.

BACKGROUND OF THE INVENTION

Powered staple guns serve a variety of purposes and often the structural configuration and operation of the staple gun is customized for a specific purpose. For example, long handled staple guns are used for stapling material on ceilings. Another type of staple gun typically used in construction includes operates as a modular powered tool with an interchangeable handle and magazine units that can drive either nails or staples.

One type of powered staple gun having a long nose for reaching otherwise inaccessible locations is described in U.S. Pat. No. 3,834,602 to Obergfell (the '602 patent). The '602 patent discloses a powered staple gun with a nosepiece or drive track of substantially increased length that does not require an increased stroke for driving the nail or staple. The powered staple gun is capable of being operated by a pneumatic motor. The staple or nail driven by the powered staple gun of the '602 patent is advanced through a drive track in increments by a series of strokes, which provide the energy for driving the staple or nail. The configuration of the powered staple gun is such that the user must hold the gun substantially perpendicular with respect to a substrate onto which an object is to be stapled. For example, if the user is stapling a linear object, such as cable or wire, the user must hold the gun at a 90 degree angle to the substrate, which results in the staples being driven over the linear object such that the body of the staple is substantially perpendicular to the linear object.

It would be desirable to have a powered stapling device that can be used to reach inaccessible or difficult to reach places. In addition, it would be desirable to have a powered stapling device that can drive staple at a desired angle even though the powered stapling device is aligned with or perpendicular to a linear object that is to be stapled.

SUMMARY OF THE INVENTION

The present invention relates to an powered stapling device and, more specifically, but not limited to, a powered stapling device for driving staples over a strip of linear material, such as a cable located in an otherwise inaccessible or difficult to reach place.

In accordance with an aspect of the invention, a stapling device includes an actuation mechanism, a handle, a staple ejection mechanism, and a drive arm operable along a primary axis of the stapling device. The actuation mechanism provides energy to the drive arm, which in turn engages the staple ejection mechanism, which in turn drives the staple. At least a portion of the staple engagement mechanism may be positioned at an angle with respect to the primary axis. This configuration of the staple engagement mechanism allows the stapling device to drive the staple at an angle relative to the linear object being stapled, even when the primary axis of stapling device is aligned substantially parallel or substantially perpendicular to the linear object being stapled.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

As will be described in further detail below, at least one embodiment of the invention is a powered stapling device for driving staples into a substrate to secure a strip of linear material, such as a strip of cable located in an otherwise inaccessible or difficult to reach place. For example, the powered stapling device may advantageously be used to drive angled staples into a substrate to secure ROMEX® nonmetallic sheathed cable or insulated electrical wire thereto. The orientation of the staples relative to a primary axis of the stapling device permits the staples to be driven into the substrate at an angle with respect to a linear path of the cable. ROMEX® nonmetallic sheathed cable or insulated electrical wire is a brand of cable/wire made by General Cable Industries, Inc. and is commonly installed in buildings in the space defined by a roof-to-ceiling joist intersection.

Figure 1:
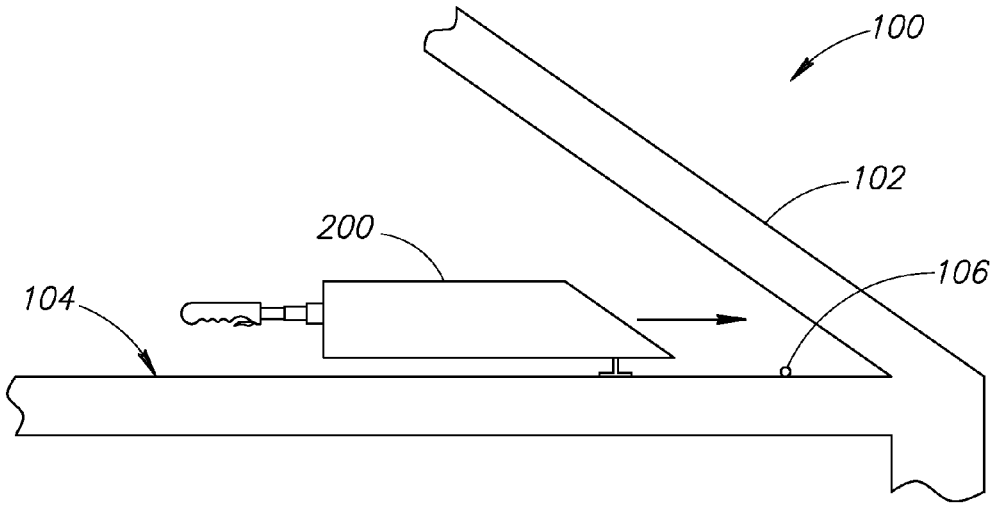
FIG. 1 is a side, elevational view of a powered stapling device being extended into a confined space according to an embodiment of the present invention.

FIG. 1 shows a building 100 having a roof portion 102 and a ceiling portion 104 with a strip of cable 106 ready to be secured to the ceiling portion 104. A stapling device 200, according to an embodiment of the present invention, is extendable to drive staples onto the cable 106 to secure the cable to the ceiling portion 104.

Figure 2:
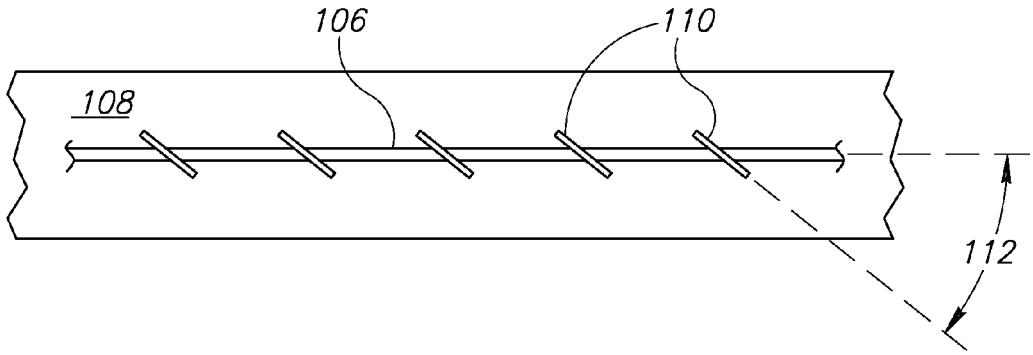
FIG. 2 is a top, plan view of material stapled into a substrate with angled staples supplied by the powered stapling device of FIG. 1.

FIG. 2 shows a linear strip of material 106 installed on a substrate 108 with staples 110. The staples 110 are driven into the substrate 108 at an angle 112, where the angle 112 is measured with respect to the path of the linear strip of material 106 according to the illustrated embodiment. The arrangement of the stapling device 200, as will be described below, permits the staples 110 to be driven into the substrate 108 at the angle 112 even when the stapling device 200 is parallel or perpendicular to the path of the linear strip material 106. The term staples, as used herein, may include, but is not limited to straight, angled, insulated, metallic, and non-metallic staples.

Figure 3:
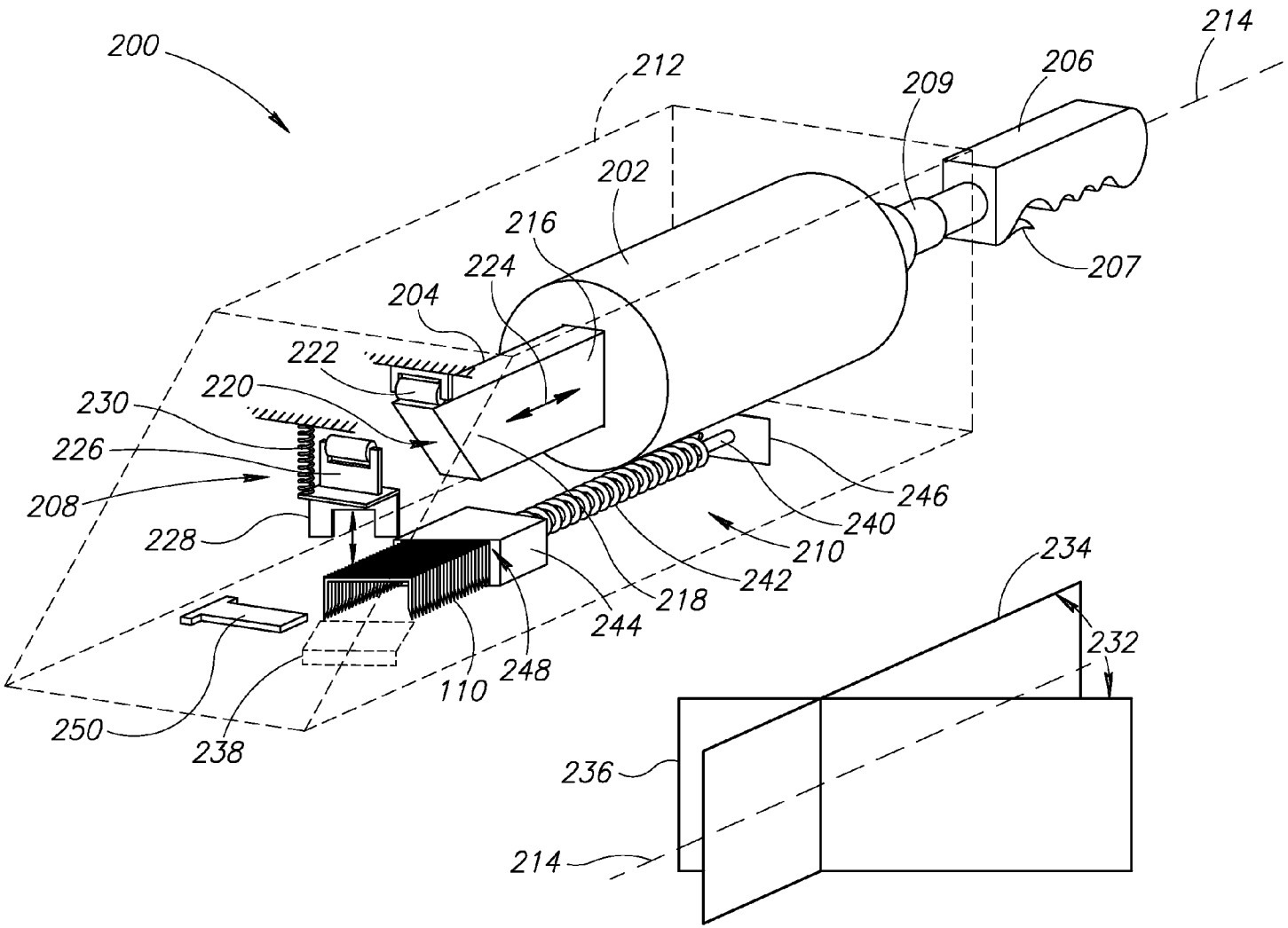
FIG. 3 is a perspective, schematic view of a powered stapling device according to an embodiment of the present invention.

FIG. 3 shows the stapling device 200 according to an illustrated embodiment of the invention. For clarity and brevity, the structural and operational components of the stapling device 200 are shown schematically. In the illustrated embodiment, the stapling device 200 includes an actuation mechanism 202, a drive arm 204, a handle 206 having a trigger 207, a staple engagement mechanism 208, and a staple feeding assembly 210. These components are located in a housing 212, which is shown in dashed lines in the illustrated embodiment.

The actuation mechanism 202 may be any mechanism capable of repeatedly moving the drive arm 204 into and out of engagement with the staple engagement mechanism 208. In one embodiment, the actuation mechanism 202 is a pneumatic assembly powered by a compressed air source (not shown). In another embodiment, the actuation mechanism 202 is a hydraulic assembly powered by a pressurized hydraulic fluid. In yet another embodiment, the actuation mechanism 202 is solenoid unit powered by an electrical source (not shown). The electrical source may be a battery, an AC power source, $CO_2$ cartridge, propane cartridge, or some equivalent power source. The actuation mechanism 202 may be coupled to the handle 206 with a telescoping rod 209 according to one embodiment. The telescoping rod 209 permits the user to extend a reach of the stapling device 200 to reach into difficult or confined spaces. Alternatively, the actuation mechanism 202 may be coupled to the handle 206 in a fixed manner.

In the illustrated embodiment, the drive arm 204 takes the form of an elongated arm operable along a primary axis 214. The drive arm 204 includes a first end 216 coupled to the actuation mechanism and a second end 218 having a surface or face 220 engageable with the staple ejection mechanism 208. The surface 220 is angled relative to the primary axis 214 such that contact with the staple ejection mechanism 208 urges the staple ejection mechanism 208 downward to eject the staple 110. In addition, a roller or bearing 222 may be located above the drive arm 204 to maintain a linear motion 224 of the drive arm 204 during actuation. The roller or bearing 222 may also operate to provide a reaction load path into the housing 212 as the drive arm 204 drives the staple 110 into the substrate 108 (FIG. 2). The roller or bearing 222 may be fixed relative to the housing 212 or may include a damping or shock absorbing mechanism (not shown), which in combination with the mass of the powered stapling device 200, helps to absorb at least some of the energy generated when the staple 110 is driven into the substrate 108.

The staple ejection mechanism 208 includes a first engagement portion 226 and a staple engagement portion 228. The first engagement portion 226 and the staple engagement portion 228 may be integrally formed as a one-piece unit or may be separate structural components that cooperate with one another. A biasing member 230, such as a tension spring, may be located between a portion of the housing 212 and the staple engagement portion 228 and operates to pull the staple ejection mechanism 208 back to a neutral, non-stapling position when the drive arm 204 moves out of engagement with the first engagement portion 226.

In the illustrated embodiment, the staple engagement portion 228 is configured to engage a top portion of a single staple 110 and is angled relative to the primary axis 214 a staple engagement angle 232. For purposes of this description, the staple engagement angle 232, is defined as the angle 232 between a first plane 234 and a second plane 236, where the first plane 234 is oriented parallel to the primary axis 214 and the second plane 236 intersects the first plane 234 to define the staple engagement angle 232. Preferably, the staple engagement angle 232 is in a range of about 30-60 degrees. In one embodiment, the staple engagement angle 232 is 45 degrees. The staple engagement angle 232 may be larger or smaller than the aforementioned ranges, but it is appreciated that the staple engagement angle 232 is not parallel or perpendicular to the primary axis 214. Accordingly, the powered stapling device 200, when oriented parallel or perpendicular to the path of the linear strip of material 106 (FIG. 2), will install staples 110 at the angle 112 (FIG. 2). In this operational example, the angle 112 and the staple engagement angle 232 are equivalent.

In one embodiment, the powered stapling device 200 further includes a guide member 238 extending from the housing 212. The guide member 238 provides the user with an approximate location of where the staple 110 will be driven. The guide member 238 may be moveable relative to the housing 212 so it does not interfere with the stapling process. For example, the guide member 238 may be extended and viewable by the user, but is permitted to retract back into the housing 212 as the staple 110 is installed into the substrate 108 (FIG. 2). The guide member 238 advantageously allows the user to accurately orient the powered stapling device 200.

The staples 110 are loaded and moved into ejection position by the staple feeding assembly 210. The staple feeding assembly 210 includes a loading rod 240, a biasing member 242, a push guide 244, and an access tab 246. The staple feeding assembly 210 is generally configured and operates like a conventional staple feeding assembly found in staple guns and office staplers with the exception of the configuration of the push guide 244. The push guide 244 includes an angled face 248 for engaging the angled staples 110. The angled face 248 coincides with the staple engagement angle 232 described above. In one embodiment, the push guide 244 may be removable and replaceable with a push guide having a different angled face 248. The push guide 244 may be fastened or otherwise attached to the loading rod 240.

In addition to the aforementioned aspects of the powered stapling device 200, a locking mechanism 250 may be engageable with the staple ejection mechanism 208, the actuation mechanism 202, or the drive arm 204 to disable or prevent stapling. In the illustrated, the locking mechanism 250 is a contact safety lock engageable with the staple ejection mechanism 208. The user manually engages and disengage the contact safety lock allow or prevent the stapling device 200 from operating. In other embodiments, the locking mechanism 250 may take the form of a keyed interlock switch, a solenoid-latching interlock, a limit switch, or some other equivalent device.

By way of example, the operation of the stapling device 200 includes the user positioning the stapling device 200 over the linear object 106 (FIG. 2). The linear object 106, for example a run of ROMEX® cable, is positioned proximate to a stapling surface or substrate 108 (FIG. 2). As described above, drive arm 204 is oriented along the primary axis 214 of the stapling device 200 such that the primary axis 214 is approximately either perpendicular or parallel to the linear object 106 when the stapling device 200 is placed in position for stapling. Once in position, the user activates the trigger 207, which is in communication with the actuation mechanism 202. The actuation mechanism 202 thereby provides the necessary energy to the drive arm 204 to urge the drive arm 204 into engagement with the staple ejection mechanism 208. This engagement drives the staple 110 over the linear object 106 and thus staples the linear object 106 to the substrate 108. Further, the staple ejection mechanism 208 drives the staple 110 over the linear object 106 at an angle, which is the staple engagement angle 232. Accordingly, the staple 110 is driven over the linear object 106 such that the staple 110 is not aligned parallel with the linear object 106 and is not perpendicular to the linear object 106. Thus in one embodiment, the staple ejection mechanism 208 driving the staple 110 over the linear object 106 results in the staple 110 being driven at the angle 232, which is in a range of about 30-60 degrees relative to the primary axis 214 of the stapling device 200. In another embodiment, the staple 110 is driven at the angle 232, which is about 45 degrees relative to the primary axis 214.

To extend the reach of the stapling device 200, the user may extend the telescoping 209 located generally between the handle 206 and the actuation mechanism 202. The telescoping rod 209 permits the user to extend a reach of the stapling device 200 to reach into difficult or confined spaces or alternatively to bring the stapling end of the device in closer proximity of the user for increased stability during stapling.

In addition, the stapling action of the stapling device 200 may include providing energy to the drive arm 204 such that the drive arm is repeatedly urged into engagement with the staple ejection mechanism 208. For example, the actuation mechanism 202 may be configured to move the drive arm 204 such that the drive arm 204 provides a series of low impact engagements with the staple ejection mechanism 208. The series of engagements may occur rapidly when the trigger 207 is activated. Advantageously, the series of low impact engagements may allow the user to better control and stabilize the stapling device 200, and in particular when the stapling device 200 is in an extended position.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The invention claimed is:

1. A method of stapling comprising:

positioning a stapling device over a linear object along a primary axis within a first plane, a second plane is orthogonal to the primary axis and intersects the first plane at the driving axis, and a roller axis lies in the second plane and is orthogonal to both the primary axis and the driving axis, a stapling angle is oblique to both the first and the second planes, the linear object positioned proximate to a stapling surface and generally parallel to either the primary or the roller axis, the stapling device having an actuation mechanism oriented for actuating movement along the primary axis;

activating a trigger in communication with the actuation mechanism of the stapling device and thereby providing energy to a staple ejection mechanism for driving a staple along the driving axis, a crown of the staple being oriented at a staple angle and outward from the primary axis over the linear object and stapling the linear object to the stapling surface, wherein the staple ejection mechanism includes a ramp engaging a roller to translate movement along the primary axis to movement along the driving axis to drive the staple when the trigger is activated.

2. The method of claim 1, wherein the staple ejection mechanism driving the staple over the linear object results in the staple being driven at the staple angle in a range of about 30-60 degrees relative to the primary axis of the stapling device.

3. The method of claim 1, wherein the staple ejection mechanism driving the staple over the linear object results in the staple being driven at the angle of about 45 degrees relative to the primary axis of the stapling device.

4. The method of claim 1, further comprising extending a telescoping member located between a handle and the actuation mechanism of the stapling device to extend a reach of the stapling device.

5. A stapling device comprising:

staple engagement means for driving a staple along a driving axis, a first plane contains a primary axis, a second plane is orthogonal to the primary axis and intersects the first plane at the driving axis, and a roller axis lies in the second plane and is orthogonal to both the primary axis and the driving axis;

actuation means for selectively moving along the primary axis and for causing the staple engagement means to drive the staple out of the stapling device along the driving axis and away from the primary axis;

wherein the staple engagement means translates actuator movement along the primary axis to drive staples at a right angle to and from the primary axis by movement of a ramp, wherein the ramp engages a roller to drive the staple; and wherein the staple is oriented such that a crown of the staple is oriented at a staple angle that is oblique to both the first and the second plane and perpendicular to the driving axis as the staple is driven along the driving axis.

6. The stapling device of claim 5, wherein at least a portion of the staple engagement means is oriented for driving movement along the driving axis.

7. The stapling device of claim 5, wherein the staple angle is an angle between about 30 and 60 degrees.

8. The stapling device of claim 5, wherein the actuation means for is actuated responsive to manipulating a trigger coupled to a handle, wherein the handle is coupled to and extends from the actuation means.

9. A stapling device comprising:

(a) a drive arm extending along a primary axis;

(b) an actuation mechanism configured to selectively move the drive arm along the primary axis;

(c) a staple feeding assembly configured to receive at least one staple having first and second legs and a crown extending between the first and second legs, the crown defining a crown axis; and (d) a staple ejection mechanism moveable by the drive arm along a driving axis, wherein the staple ejection mechanism is engageable with the crown to drive the at least one staple out of the stapling device, the staple ejection mechanism oriented to define an oblique staple engagement angle relative to the primary axis and the drive axis.

10. The stapling device of claim 9, wherein the driving axis is substantially perpendicular to the primary axis.

11. The stapling device of claim 9, wherein the staple engagement angle is adjustable.

12. The stapling device of claim 9, wherein the staple feeding assembly further comprises a push member having a contact face being oriented at substantially the staple engagement angle, the contact face configured to urge the at least one staple toward the staple ejection mechanism.

13. The stapling device of claim 12, wherein the contact face defines a planar surface that is substantially perpendicular to the primary axis.

14. The stapling device of claim 12, further comprising a biasing member coupled to the push member that urges the push member toward the staple ejection mechanism.

15. The stapling device of claim 12, wherein the staple feeding assembly is configured to receive a plurality of staples, each of the plurality of staples having a crown axis that are substantially parallel with each other.

16. The stapling device of claim 9, further comprising a guide member located near the staple ejection mechanism, the guide member indicative of an approximate location where a staple will be driven, and the guide member viewable by an operator of the stapling device so the operator is able to accurately orient the stapling device when driving staples.

17. A stapling device comprising:

(a) a drive arm extending along a primary axis;

(b) an actuation mechanism configured to selectively move the drive arm along the primary axis;

(c) a staple feeding assembly configured to receive at least one staple having first and second legs and a crown extending between the first and second legs, the crown defining a crown axis, wherein the at least one staple is receivable within the staple feeding assembly to define an oblique staple engagement angle between the primary axis and the crown axis; and (d) a staple ejection mechanism moveable by the drive arm along a driving axis, wherein the staple ejection mechanism is engageable with the crown to drive the at least one staple out of the stapling device, the staple ejection mechanism oriented to define an oblique staple engagement angle relative to the primary axis and the drive axis.

18. The stapling device of claim 17, wherein the driving axis is substantially perpendicular to the primary axis.

19. The stapling device of claim 18, wherein the staple engagement angle is adjustable.

20. The stapling device of claim 19, wherein the staple feeding assembly further comprises a push member having a contact face being oriented at substantially the staple engagement angle, the contact face configured to urge the at least one staple toward the staple ejection mechanism.

21. The stapling device of claim 19, wherein the staple feeding assembly is configured to receive a plurality of staples, each of the plurality of staples having a crown axis that are substantially parallel with each other.

* * * * *

UNITED STATES PATENT AND TRADEMARK OFFICE

CERTIFICATE OF CORRECTION

PATENT NO. : 8,136,710 B2
APPLICATION NO. : 11/681018
DATED : March 20, 2012
INVENTOR(S) : L. D. Stratton It is certified that error appears in the above-identified patent and that said Letters Patent is hereby corrected as shown below:

| COLUMN | LINE | ERROR |
|---|---|---|
| (57) Title Pg. 1, col. 2 | Abstract 1 of text | "an powered" should read --a powered-- |
| (57) Title Pg. 1, col. 2 | Abstract 15 of text | "of stapling device" should read --of the stapling device-- |
| 6 (Claim 8, | 10-11 lines 1-2) | "actuation means for is actuated" should read --actuation means is actuated-- |
| 6 (Claim 9, | 27 line 14) | "drive axis." should read --driving axis.-- |
| 7 (Claim 17, | 2 line 17) | "drive axis." should read --driving axis.-- |

Signed and Sealed this
Twenty-sixth Day of March, 2013

Teresa Stanek Rea
*Acting Director of the United States Patent and Trademark Office*